US010288386B1

(12) United States Patent
Moore

(10) Patent No.: US 10,288,386 B1
(45) Date of Patent: May 14, 2019

(54) BODY ARMOR AND BODY ARMOR MANUFACTURING METHODS

(71) Applicant: Brian Moore, Charlotte, MI (US)

(72) Inventor: Brian Moore, Charlotte, MI (US)

( * ) Notice: Subject to any disclaimer, the term of this patent is extended or adjusted under 35 U.S.C. 154(b) by 0 days.

(21) Appl. No.: 15/782,689

(22) Filed: Oct. 12, 2017

Related U.S. Application Data

(60) Provisional application No. 62/407,207, filed on Oct. 12, 2016.

(51) Int. Cl.
*B21D 5/02* (2006.01)
*F41H 5/02* (2006.01)
*B21D 5/00* (2006.01)

(52) U.S. Cl.
CPC ..... *F41H 5/02* (2013.01); *B21D 5/00* (2013.01); *B21D 5/02* (2013.01)

(58) Field of Classification Search
CPC ..... B21D 5/00; B21D 5/002; B21D 5/006; B21D 5/01; B21D 5/02; B21D 5/16; B21D 5/0209; F41H 5/02
See application file for complete search history.

(56) References Cited

U.S. PATENT DOCUMENTS

| | | | | |
|---|---|---|---|---|
| 2,103,562 | A * | 12/1937 | Smith | B21D 51/02 72/353.2 |
| 3,162,861 | A | 12/1964 | Gustafson | |
| 3,952,574 | A * | 4/1976 | Speidel | B21D 11/20 72/379.2 |
| 4,660,223 | A | 4/1987 | Fritch | |
| 6,002,118 | A * | 12/1999 | Kawano | B21D 11/20 219/602 |
| D569,046 | S | 5/2008 | Crye et al. | |
| D638,583 | S | 5/2011 | Bishop | |
| 8,186,340 | B2 * | 5/2012 | Soucy | F24J 2/10 126/627 |
| 9,021,612 | B1 | 5/2015 | O'Neal | |
| 9,046,324 | B2 | 6/2015 | Bergman et al. | |
| 9,671,199 | B1 * | 6/2017 | Miller | C21D 6/00 |
| 2004/0216595 | A1 | 11/2004 | Dickson | |
| 2007/0220736 | A1 * | 9/2007 | Yamazaki | B23P 15/00 29/527.4 |
| 2012/0067100 | A1 * | 3/2012 | Stefansson | B21D 5/00 72/342.1 |
| 2016/0138894 | A1 | 5/2016 | Heise | |
| 2016/0223295 | A1 | 8/2016 | Tepper | |

* cited by examiner

*Primary Examiner* — Edward T Tolan
(74) *Attorney, Agent, or Firm* — Wells St. John P.S.

(57) ABSTRACT

Four-bend body armor plates are provided that can include a chest bend, two wither bends, and a central line bend. Methods for manufacturing a body armor plate are provided that can include individually providing a chest bend, a central line bend, and two wither bends within the plate itself using the same stamp assembly.

4 Claims, 16 Drawing Sheets

BODY ARMOR AND BODY ARMOR MANUFACTURING METHODS

CROSS REFERENCE TO RELATED APPLICATION

This application claims priority to U.S. Provisional Patent Application Ser. No. 62/407,207 filed Oct. 12, 2016, entitled "Body Armor and Body Armor Manufacturing Methods," the entirety of which is incorporated by reference herein.

TECHNICAL FIELD

This disclosure relates to body armor and in particular embodiments single plate chest protector body armor and methods for manufacturing same.

BACKGROUND

Body armor has been around for centuries, but the present disclosure deals particularly with steel body armor. Steel body armor has been notoriously difficult to mold or bend, because it will typically ripple or fold before it will bend in ordinary circumstances as the body armor is typically a thinner sheet of steel. Another disadvantage of single sheet body armor is that the sheet is usually only produced in flat or single-curve configuration. This configuration, combined with its extra weight, tends to make it uncomfortable to wear, especially over an extended period of time, since it does not properly conform to the body and therefore concentrates undue pressure on limited areas of the body.

The present disclosure provides body armor methods with multiple bends and processes for making such body armor.

DRAWINGS

Embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

Four-bend body armor plates are provided that can include a chest bend, two wither bends, and a central line bend.

Methods for manufacturing a body armor plate are provided that can include individually providing a chest bend, a central line bend, and two wither bends within the plate itself using the same stamp assembly.

Figure 1:
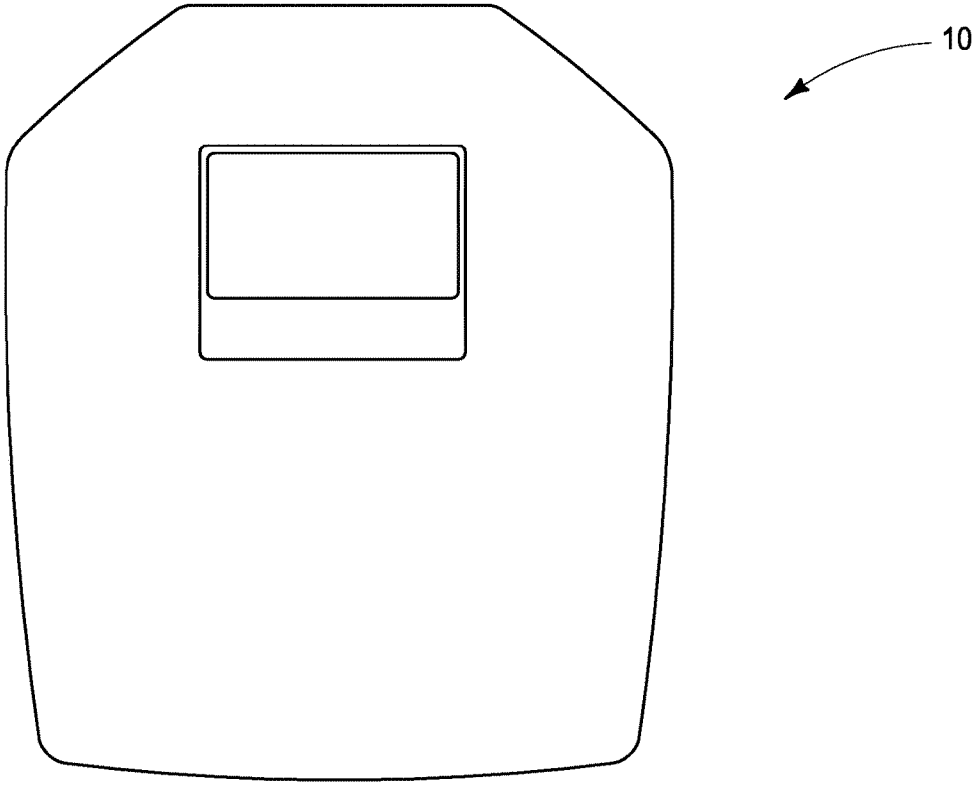
FIG. 1 is a body armor plate according to an embodiment of the disclosure.

The body armor plates and manufacturing methods will be described with reference to FIGS. 1-16. Referring first to FIG. 1, a body armor plate 10 is shown that depicts one side, or the frontal surface, of the body armor plate. This body armor plate can be utilized in conjunction with a fabric vest as desirable, and according to example implementations, the body armor plate hangs more comfortably than the prior art plates.

Figure 2:
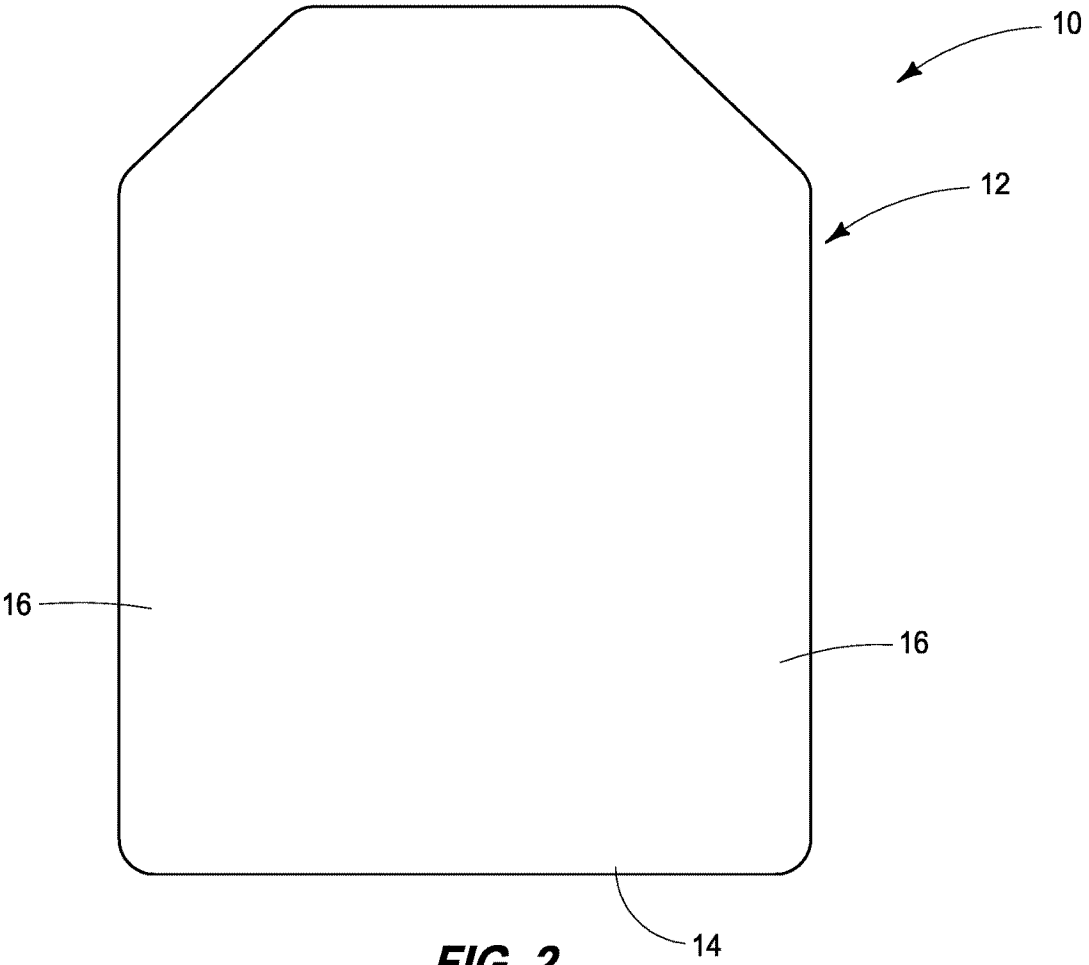
FIG. 2 is an interior side of a body armor plate according to an embodiment of the disclosure.
Figure 3:
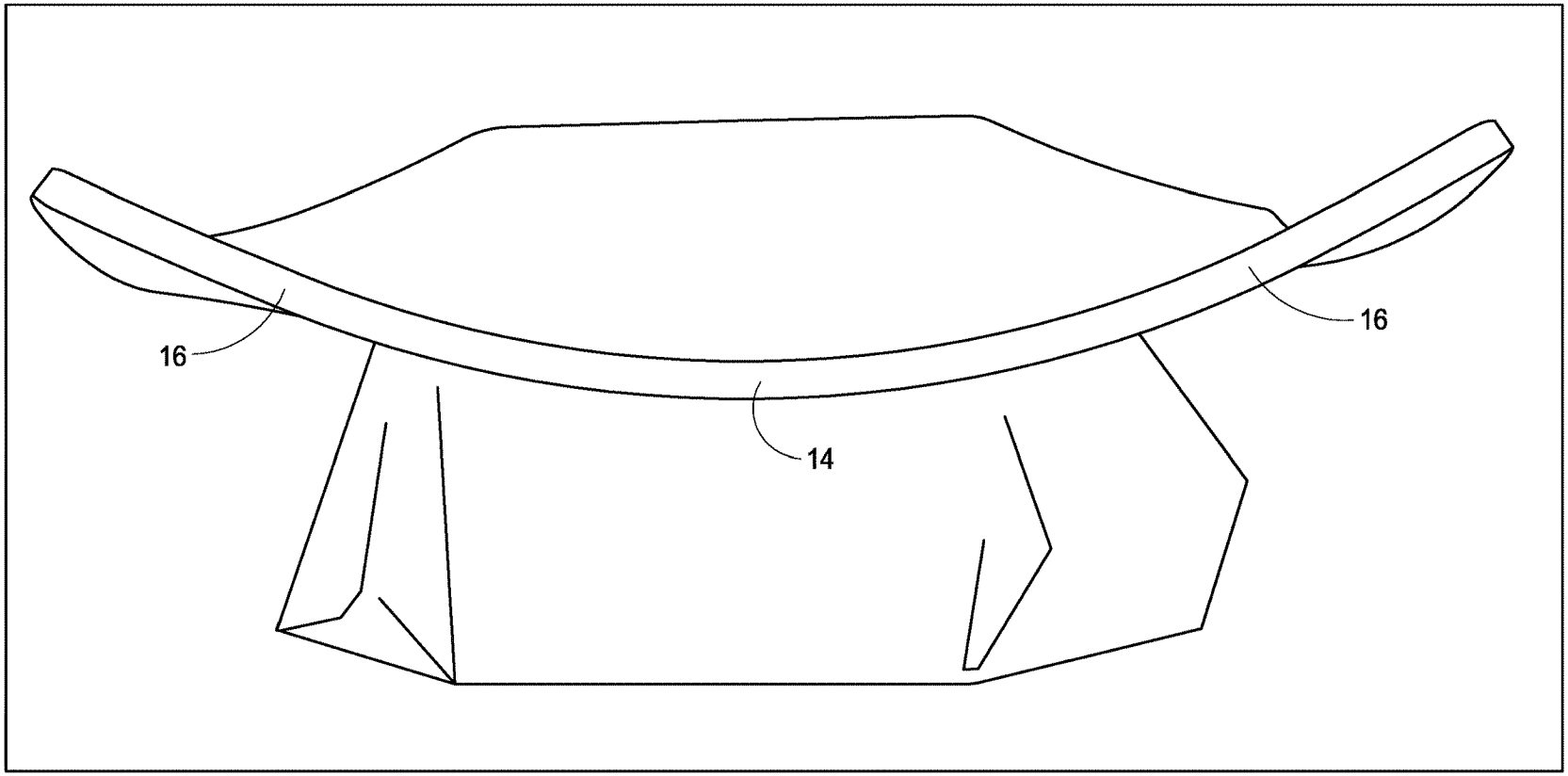
FIG. 3 is a side view of a body armor plate according to an embodiment of the disclosure.
Figure 4:
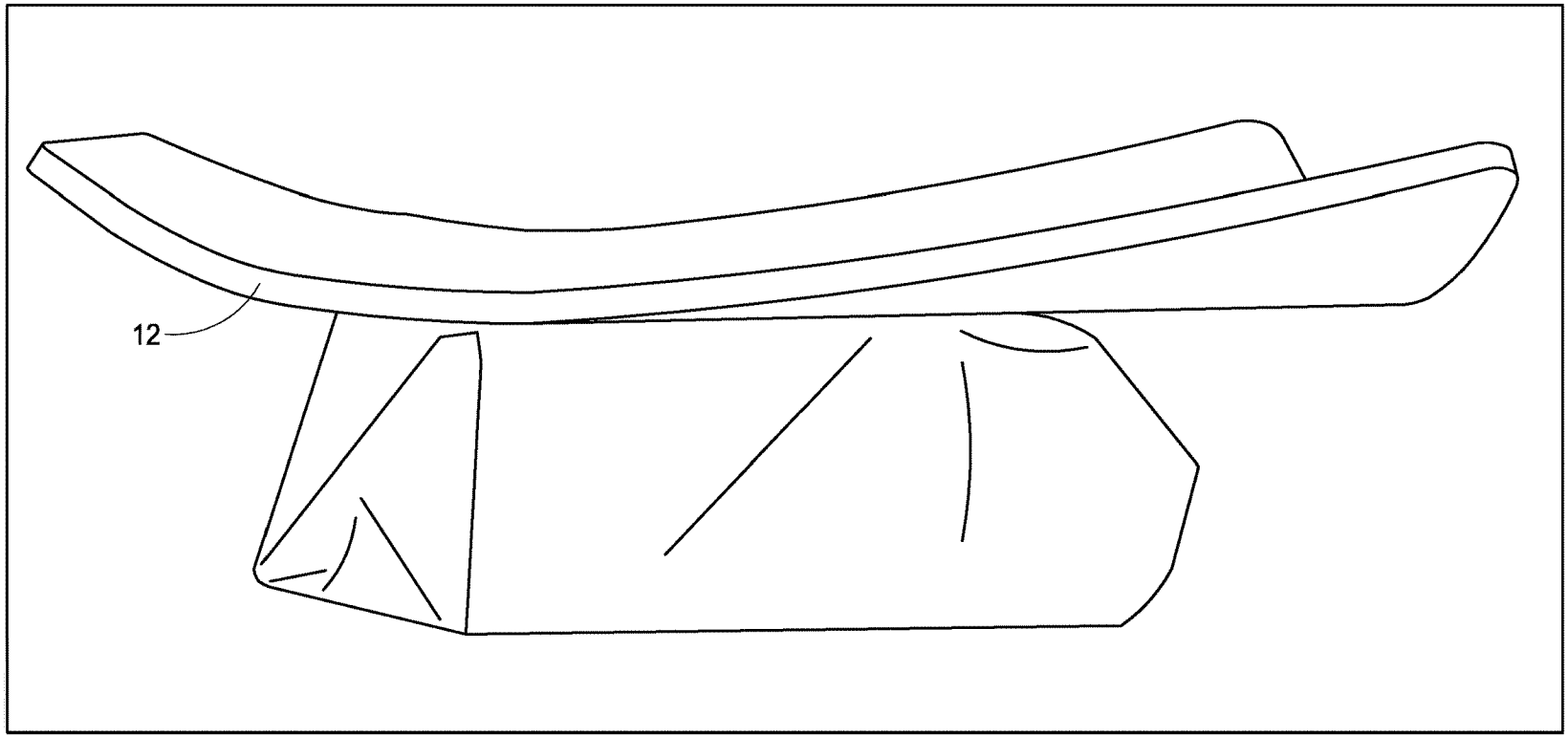
FIG. 4 is another side view of the plate of FIG. 3 according to an embodiment of the disclosure.
Figure 5:
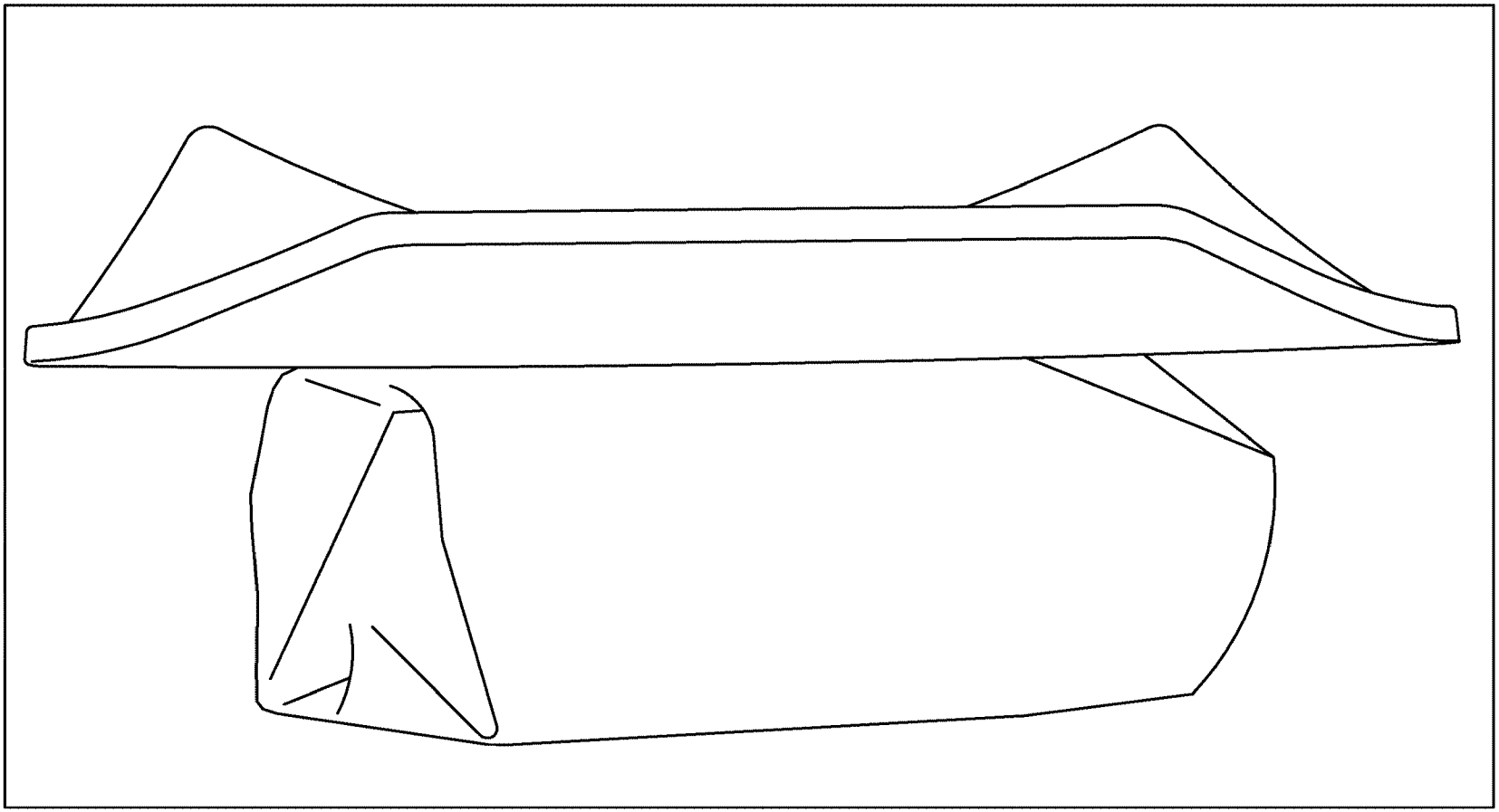
FIG. 5 is yet another view of the plate of FIG. 3 and Fig, 4 according to an embodiment of the disclosure.
Figure 6:
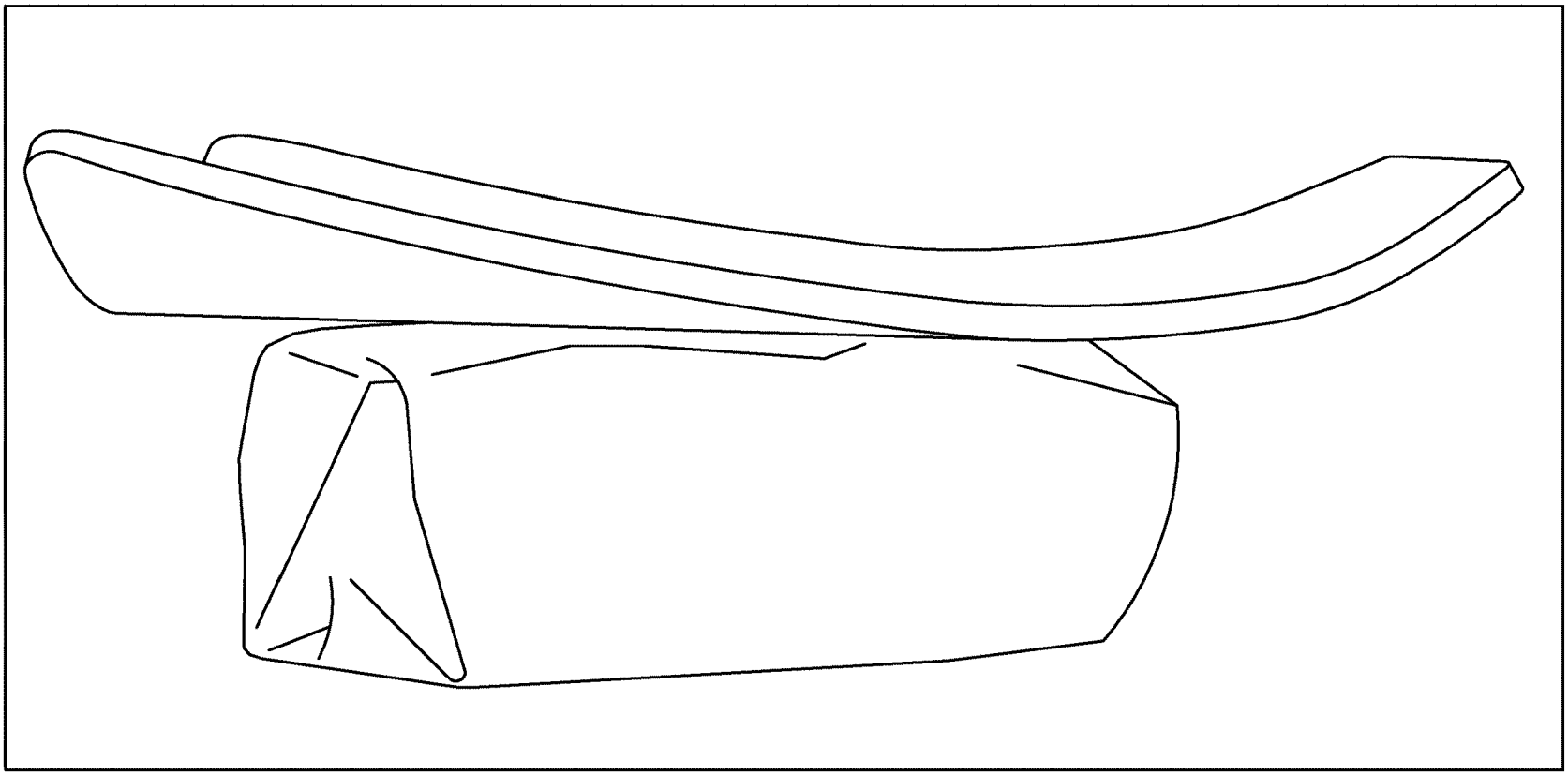
FIG. 6 is yet another view of the body armor plates of FIGS. 3-5 according to an embodiment of the disclosure.

Referring to FIG. 2, the opposing surface or interior surface of the body armor plate is shown that includes bend partitions 12, 14 and 16. As can be seen, this body armor plate includes at least four bends, with a chest bend 12, a center bend 14, and two wither or side bends 16.

Referring next to FIGS. 3-6, views of the body armor plate according to the present disclosure are provided from every side as the body armor plate is supported. Particularly, body armor plate 10 has bends 16 and 14 as well as bend 12. As can be seen, the bends 16 are to be aligned upon the withers of the person utilizing the body armor plate and 12 is to extend at least proportionately about the chest area of the person wearing the body armor plate.

Figure 7:
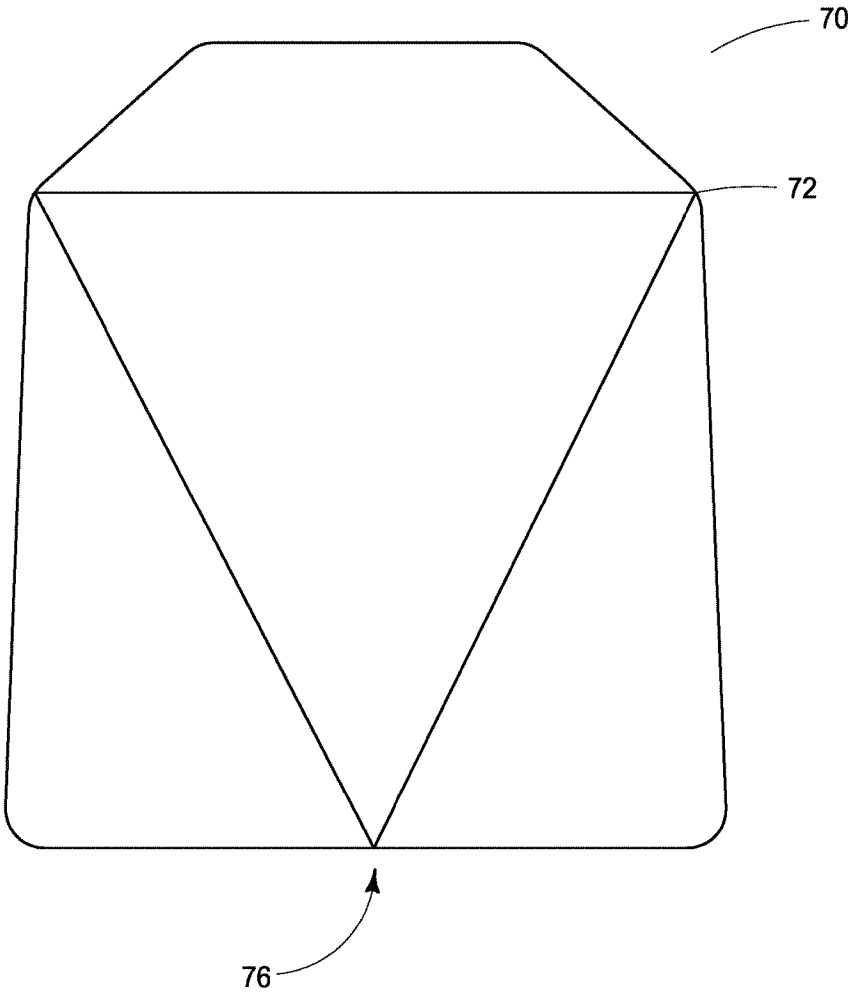
FIG. 7 is a depiction of a body armor plate in one stage of process according to an embodiment of the disclosure.

Referring next to FIG. 7, a body armor plate 70 is shown in one stage of processing. Body armor plate 70 includes die casting lines 72 and point 76. As can be seen, plate 70 includes an angled portion at the upper portion as well as square or normal portions at the lower right and left portions. According to example configurations, upper casting line can run across plate 70 to define an edge of an upper trapezoid portion shared with an edge of a lower rectangle portion. Plate 70 can include side casting lines that run from the ends of upper casting line in a triangular form to a center point of the lower portion at point 76.

Figure 8:
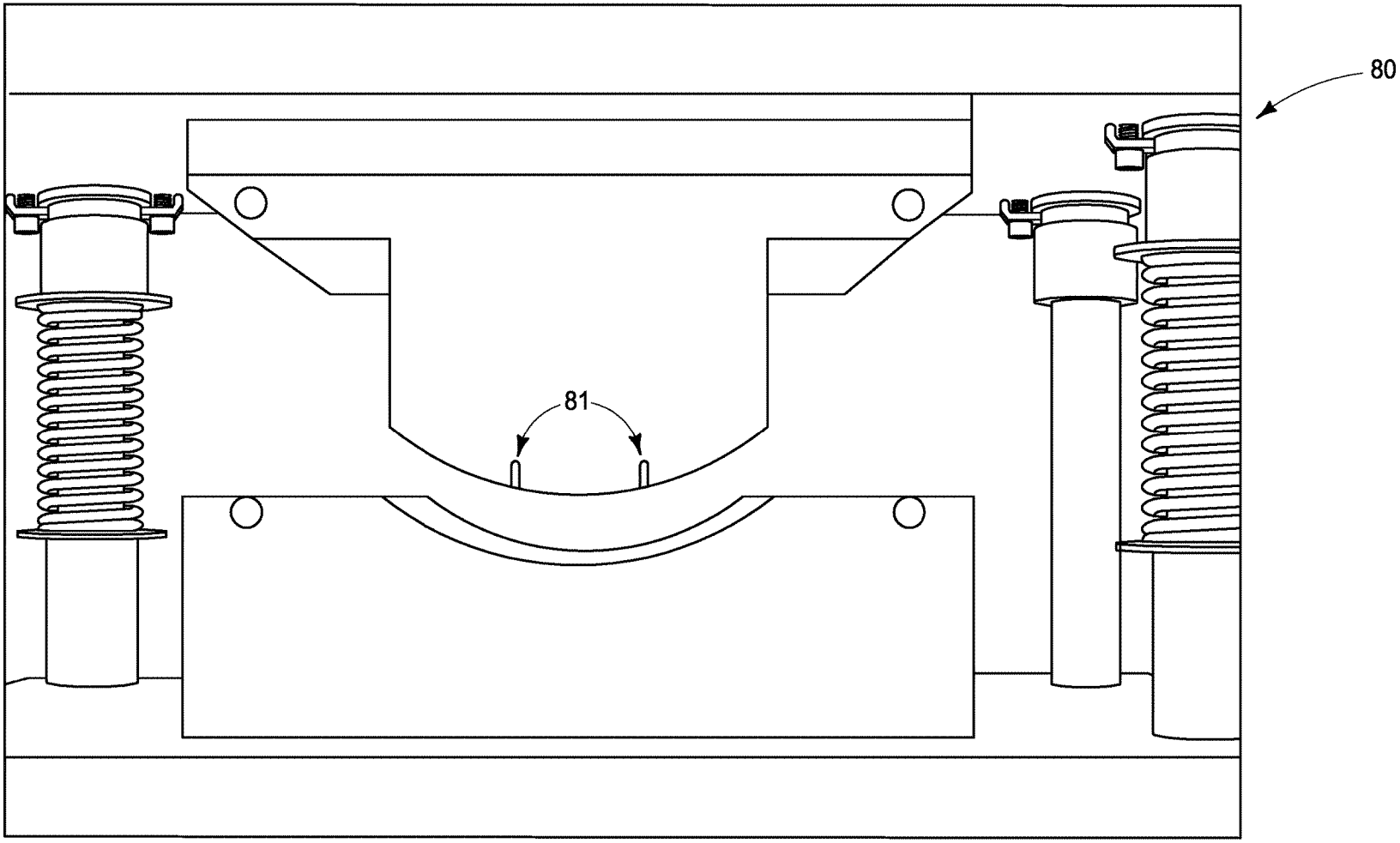
FIG. 8 is a die cast press according to an embodiment of the disclosure for use and methods of manufacturing the body armor plate.

Referring next to FIG. 8, a classic die press 80 is shown. This die press 80 includes a couple of notch lines 81. These notch lines can be used to line up with lines 72 during the manufacturing process. In accordance with example implementations, the die press can have a 4¾" radius, and the die can be 6" wide, and about 8½" long. The two alignment marks 81 are at 2" and 4", about the width of the die cast. The body armor plate can typically be about ¼" thick to 5 mm thick, also up to ½" thick, in other embodiments the thickness can be 0.125, 0.210, or up to 0.250 inches thick. The plate itself can be 8"×10", 10"×12", or 11"×14" for example. The sheets themselves can be made of AR500 steel with a hardness greater than 500 but less than 520, and AR550 steel with a hardness greater than 550, and in the 5 mm designs, the hardness can be greater than 610, for example.

Figure 9:
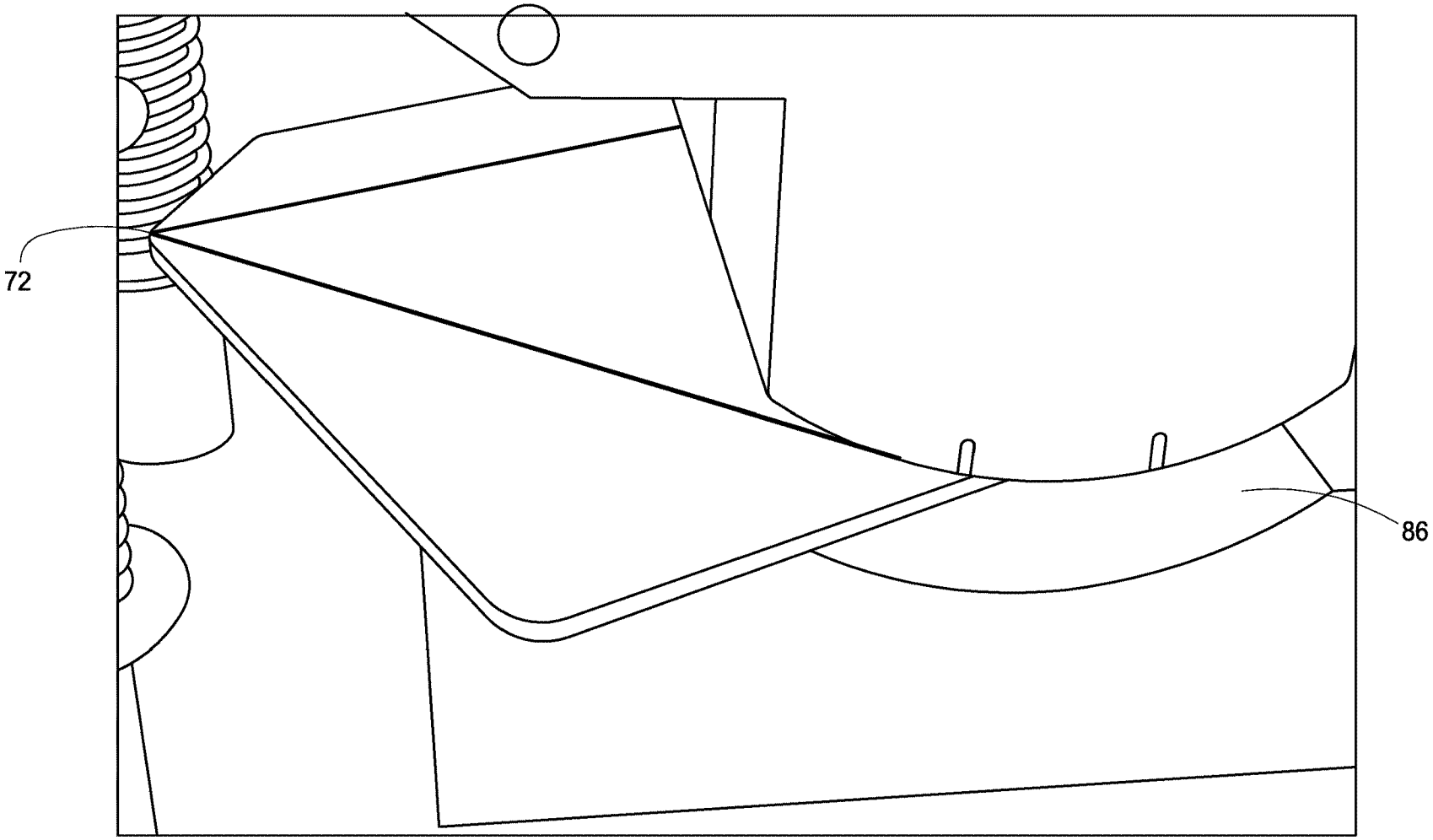
FIG. 9 is a body armor plate in one stage of manufacturing according to an embodiment of the disclosure.
Figure 10:
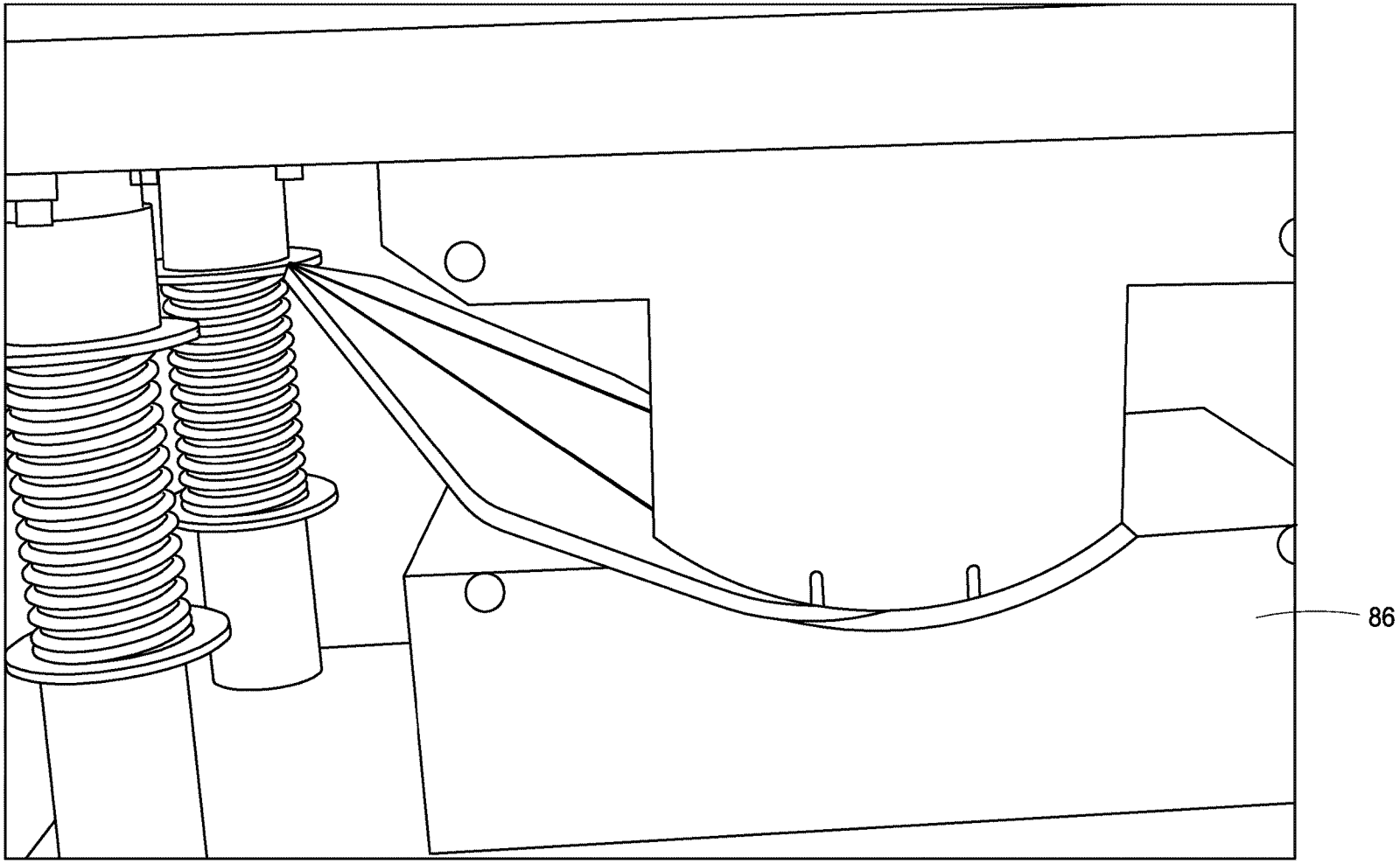
FIG. 10 is a body armor plate in another stage of manufacturing according to an embodiment of the disclosure.
Figure 11:
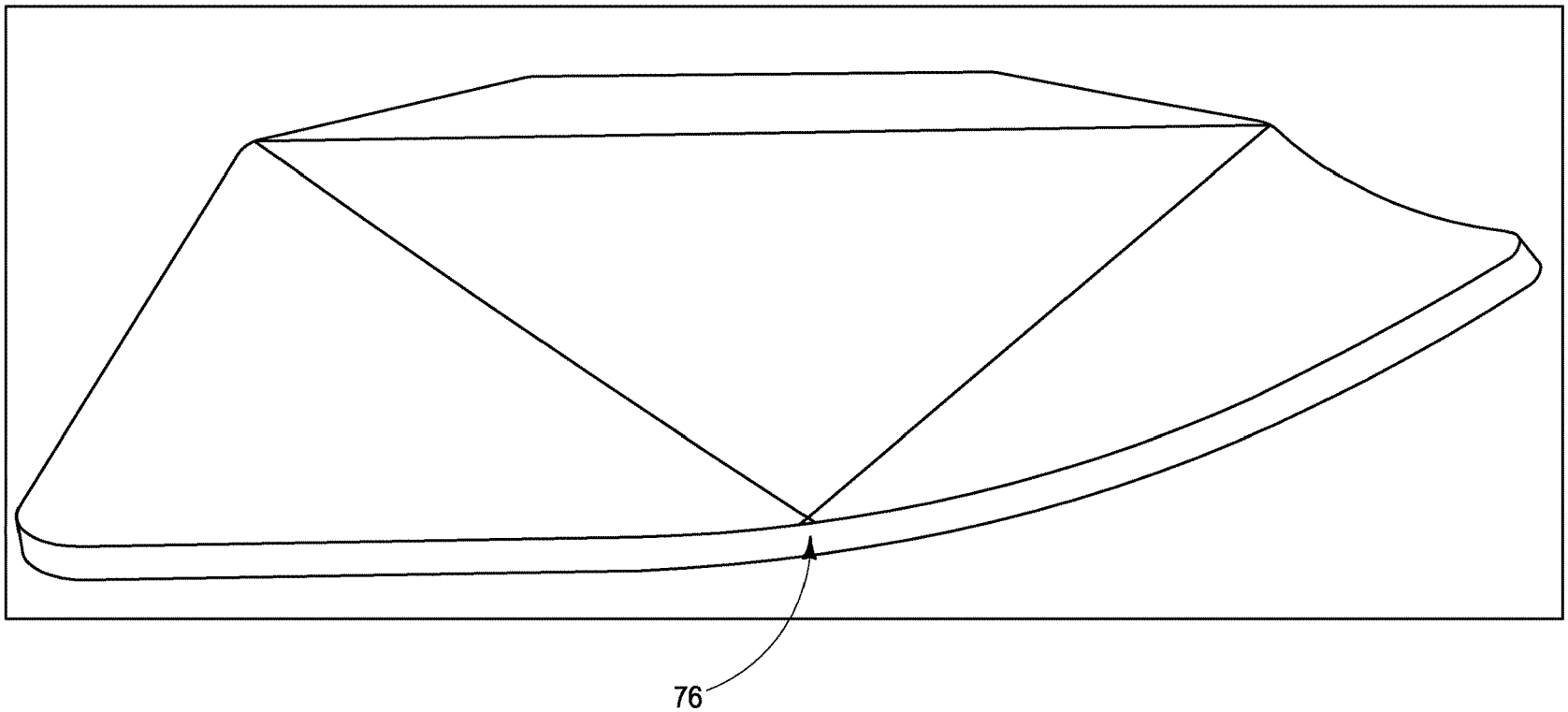
FIG. 11 is a body armor plate in one stage of manufacturing according to an embodiment of the disclosure.
Figure 12:
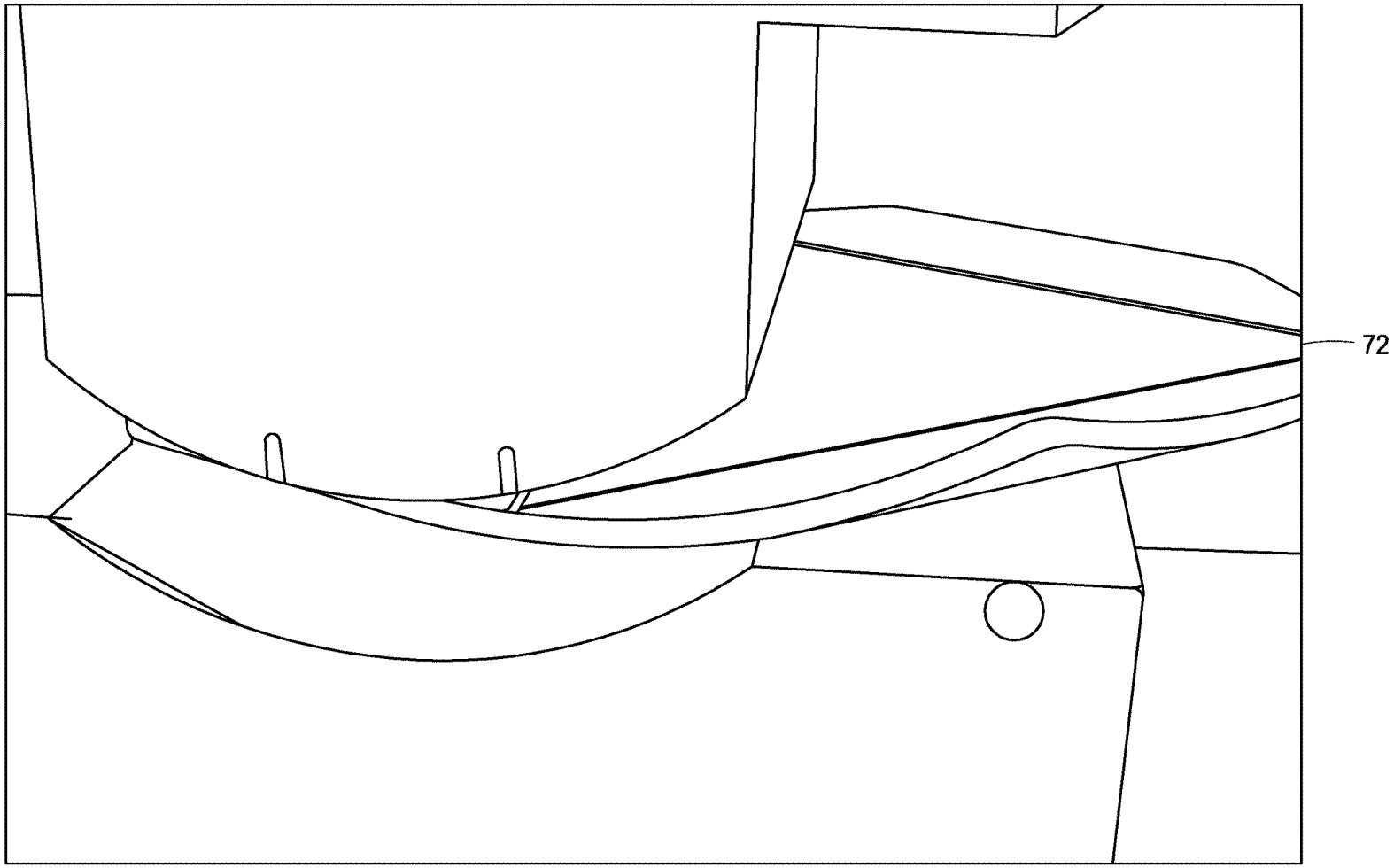
FIG. 12 is a body armor plate according to one stage of manufacturing according to an embodiment of the disclosure.
Figure 13:
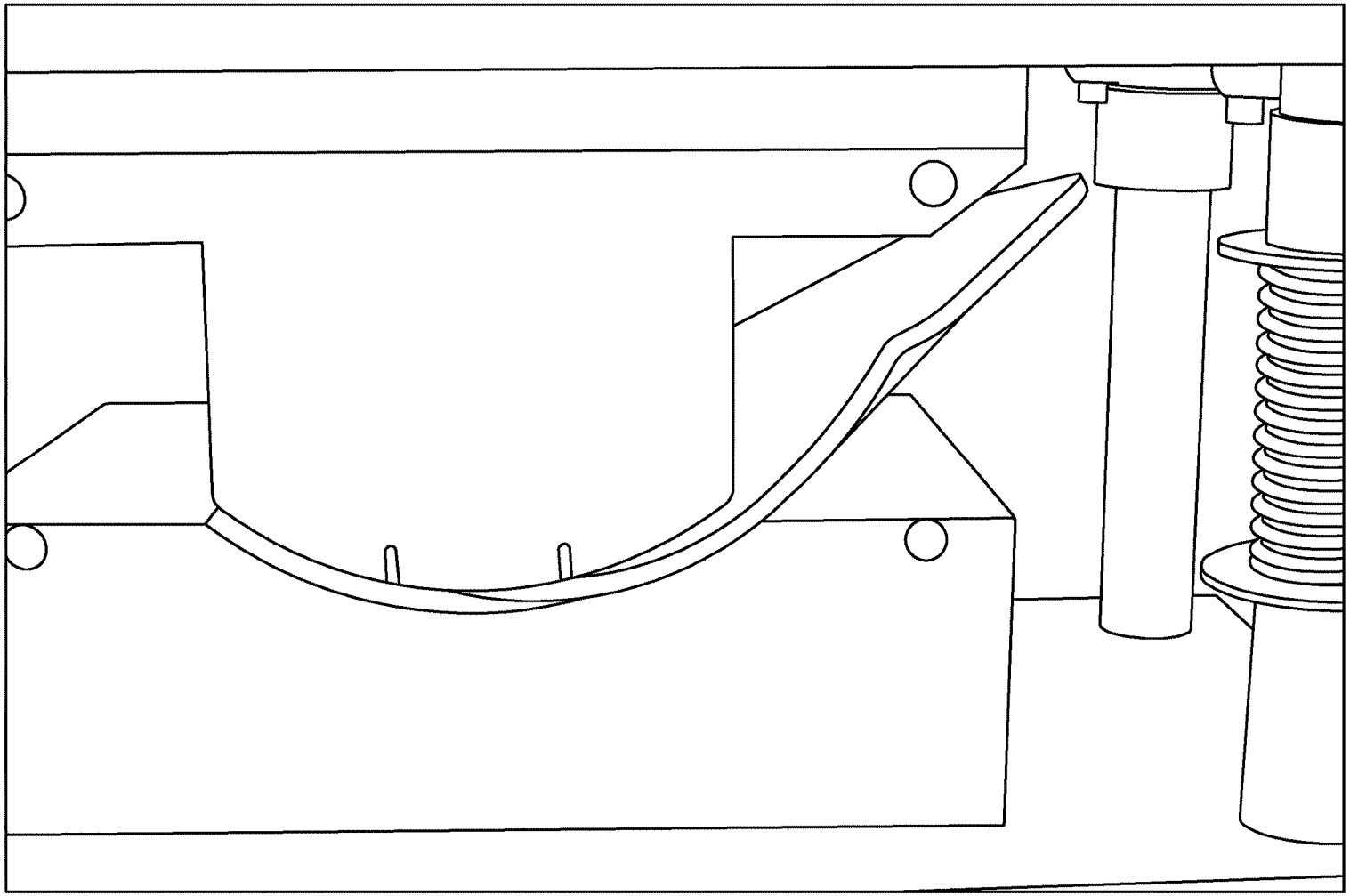
FIG. 13 is a body armor plate according to one stage of manufacturing according to an embodiment of the disclosure.
Figure 14:
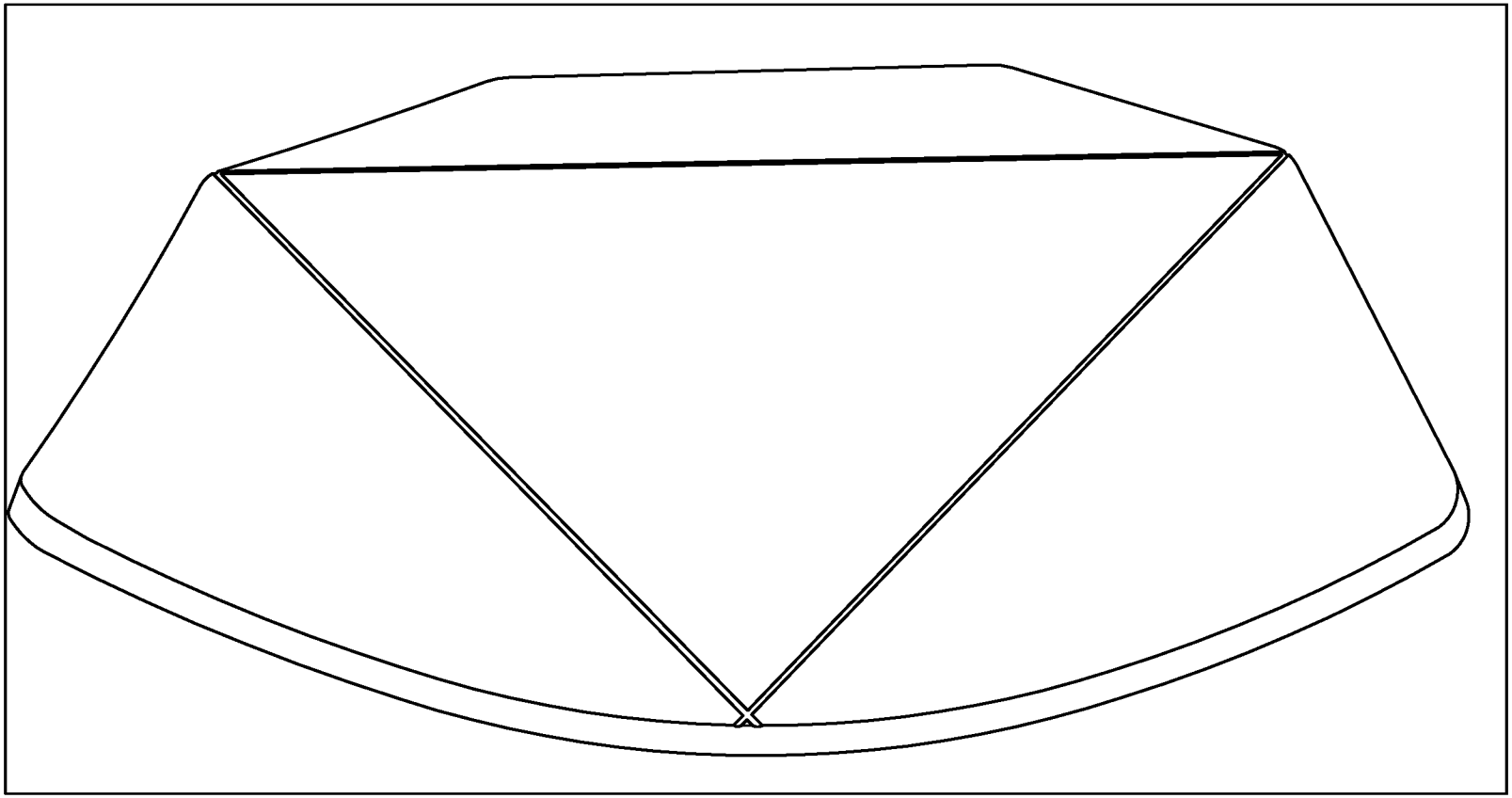
FIG. 14 is a body armor plate at one stage of manufacturing according to an embodiment of the disclosure.
Figure 15:
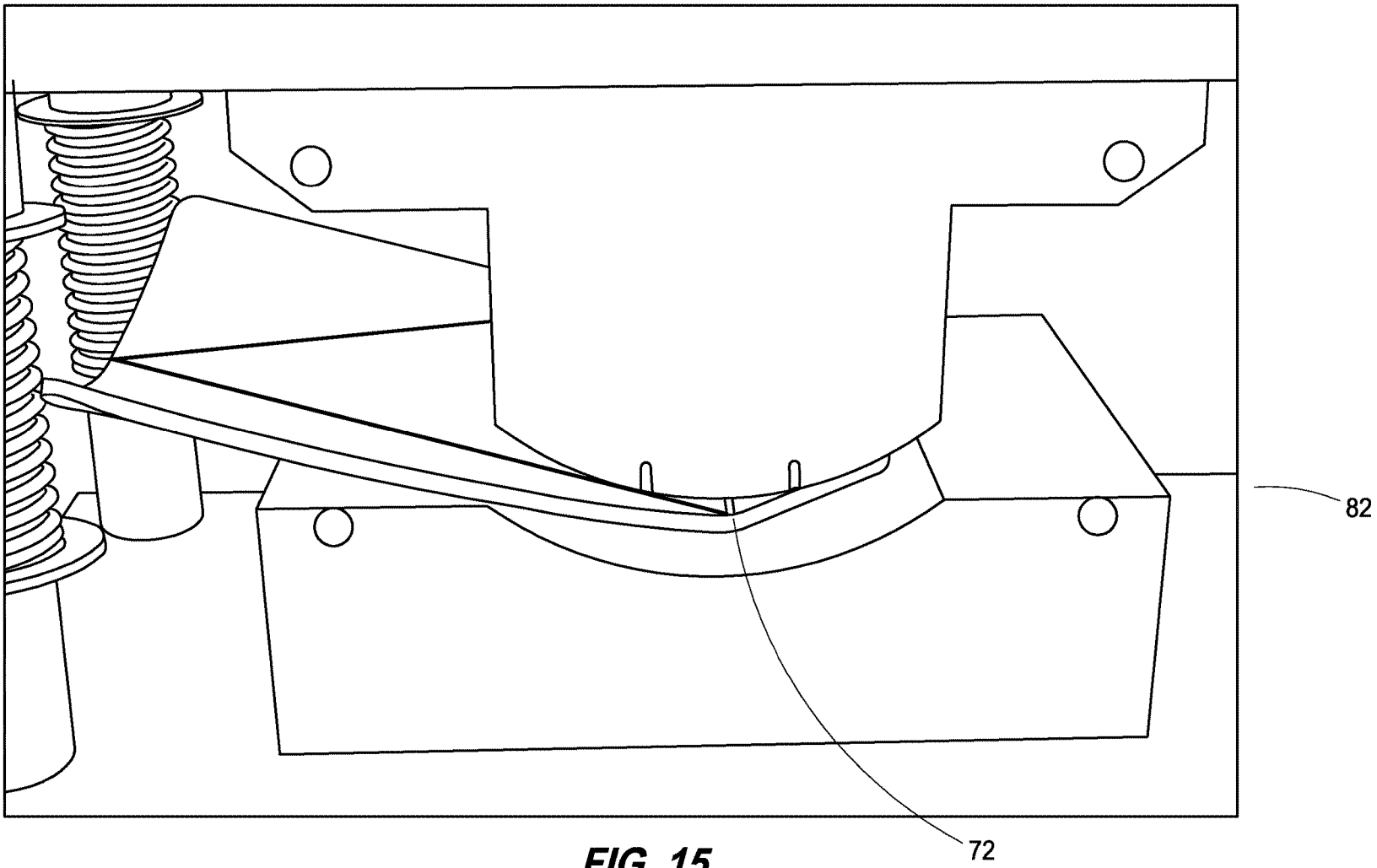
FIG. 15 is a body armor plate in process according to an embodiment of the disclosure.
Figure 16:
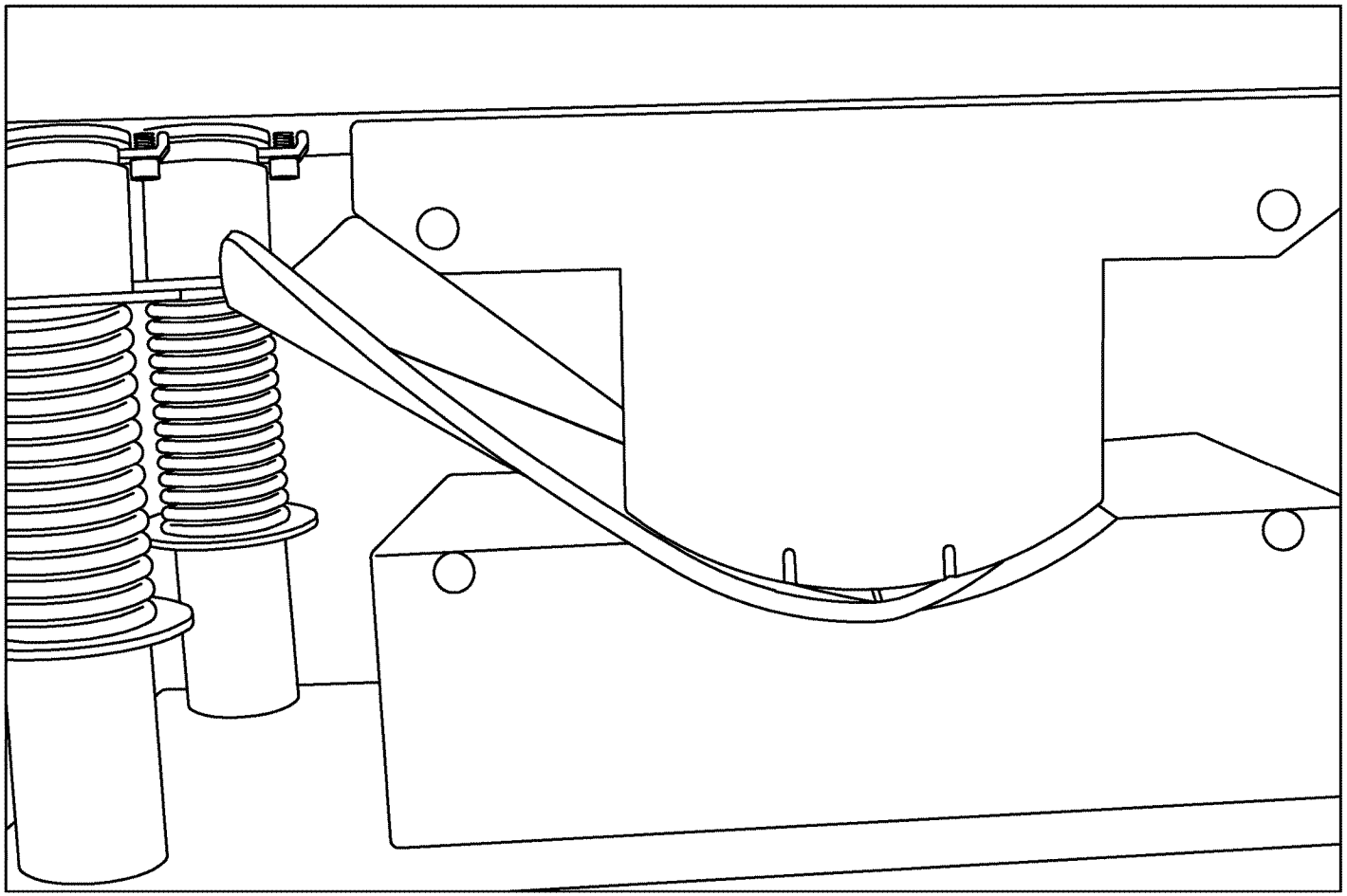
FIG. 16 is a body armor plate in process according to an embodiment of the disclosure.

Referring to FIG. 9 one notch line is shown lined up with one of the two side casting lines for example. Referring to FIG. 10, as can be seen, one of the notch lines can be aligned with one of the lines in this particular embodiment and the press activated to bend the body armor. As can be seen, the line can be side casting line and the notch aligned with same to create a bend in FIG. 11. The plate can then be moved to the other side of the press, and the other side casting line can be aligned with the opposing notch 81, and bent as shown in FIGS. 12 and 13 to create a dual bend as shown in FIG. 14. Referring next to FIGS. 15 and 16, to create the chest bend, the upper casting line can be aligned directly between the two notch points, and the press activated to create the chest bend as shown in FIGS. 15 and 16. Upon completion of preparing the bends in the body armor, the body armor can be shot blasted to clean up residual particulates in the manufacturing process, cleansed with an organic solvent such as acetone, for example, dried, and then an adhesive primer applied thereto, and then a polyurea coating applied thereto.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect.

The invention claimed is:

1. A method for manufacturing a body armor plate, the method comprising:

providing a substantially unbent steel plate defining a trapezoid portion sharing one edge with a rectangular portion, the rectangular portion having another edge opposing the one edge;

marking the plate with an isosceles triangle, a baseline of the isosceles triangle extending along the one edge shared by the trapezoid portion and the rectangular portion, and the sidelines of the isosceles triangle forming the isosceles triangle vertex at a midpoint of the other edge opposing one edge;

aligning the plate within a press along the marked baseline and bending the plate within the press along the baseline of the triangle; and after bending the plate along the baseline of the triangle, independently aligning the plate within the press along each of the marked sidelines and bending the plate along each of the sidelines of the triangle.

2. The method of claim 1 further comprising providing a die press having a 4¾ inch radius.

3. The method of claim 2 wherein the die press is about 6 inches wide and defines two marks at 2 inches and 4 inches about a width of the die cast.

4. The method of claim 3 wherein the die press is about 8½ inches long having complimentary markings at both ends.

* * * * *